US010234228B2

(12) United States Patent
Person

(10) Patent No.: US 10,234,228 B2
(45) Date of Patent: Mar. 19, 2019

(54) FIREARM NOISE SUPPRESSOR

(71) Applicant: Matt Person, Denton, NE (US)

(72) Inventor: Matt Person, Denton, NE (US)

( * ) Notice: Subject to any disclaimer, the term of this patent is extended or adjusted under 35 U.S.C. 154(b) by 0 days.

(21) Appl. No.: 15/199,926

(22) Filed: Jun. 30, 2016

(65) Prior Publication Data

US 2017/0003094 A1 Jan. 5, 2017

Related U.S. Application Data

(60) Provisional application No. 62/187,308, filed on Jul. 1, 2015.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/28; F41A 21/32; F41A 21/325; F41A 21/34; F41A 21/36
USPC ..... 89/14.4, 14.2, 14.3; 42/1.06, 77, 79, 107
See application file for complete search history.

(56) References Cited

U.S. PATENT DOCUMENTS 4,454,798 A * 6/1984 Shea ..... F41A 21/30 181/223
5,016,378 A * 5/1991 Sain ..... F41A 17/52 42/1.01
5,078,043 A * 1/1992 Stephens ..... F41A 3/62 181/223
5,101,589 A * 4/1992 Duncan ..... F41G 1/345 42/1.01
5,136,923 A * 8/1992 Walsh, Jr. ..... F41A 21/30 89/14.2
6,298,764 B1 * 10/2001 Sherman ..... F41A 21/34 89/14.2
6,575,266 B1 * 6/2003 Gehse ..... F41A 21/30 181/223

(Continued)

FOREIGN PATENT DOCUMENTS

DE 10 2010 019358 A1 11/2011
FR 475 519 A 5/1915

(Continued)

OTHER PUBLICATIONS

"Communication of the Extended Search Report and Search Opinion" by the European Patent Office in Munich, Germany, for European Application No. 16177631.5, dated Nov. 7, 2016, 7 pages.

*Primary Examiner* — John Cooper
(74) *Attorney, Agent, or Firm* — Zarley Law Firm, P.L.C.

(57) ABSTRACT

The present invention relates to a fire arm silencer that utilizes internal reflection of shock waves and redirection of propulsive gasses to reduce the noise caused by the firing of a fire arm. The fire arm noise suppressor is comprised of a hollow body comprised of an end wall and a central opening with an inner tube extending partially within the body from the end wall of the hollow body. The inner tube has open ends and communicates with the central opening of the hollow body. Positioned between the inner tube and inner surface of the hollow body is a noise attenuating truss structure that is formed to break shock waves and redirect propellant gasses. The body further comprises a second end having an end wall that terminates into an outwardly extending hub. The hub has a centrally located bore that is formed to receive the end of a barrel of a firearm.

11 Claims, 5 Drawing Sheets

(56) References Cited

U.S. PATENT DOCUMENTS 8,464,451 B2 * 6/2013 McRae ..... F41A 17/06 42/1.01
8,662,694 B1 * 3/2014 Izumi ..... F41G 1/34 362/109
8,782,937 B2 * 7/2014 Grossman ..... F41A 17/46 42/1.01
9,038,771 B1 * 5/2015 Mueller ..... F41A 21/30 181/223
9,347,727 B1 * 5/2016 Cler ..... F41A 21/30
2006/0080881 A1 * 4/2006 Cuprin ..... F41A 17/066 42/70.02
2007/0107590 A1 * 5/2007 Silvers ..... F41A 21/30 89/14.4
2008/0025039 A1 * 1/2008 Guillermo ..... A42B 3/044 362/556
2008/0039962 A1 * 2/2008 McRae ..... F41A 17/06 700/90
2010/0126334 A1 * 5/2010 Shults ..... F41A 21/30 89/14.4
2010/0251586 A1 * 10/2010 Packer ..... F41A 19/01 42/1.01
2010/0299985 A1 * 12/2010 Delgado Acarreta ... F41A 19/01 42/1.03
2011/0016760 A1 * 1/2011 Longo ..... F41A 9/65 42/49.01
2011/0072703 A1 * 3/2011 Ferrarini ..... F41A 19/01 42/1.01
2011/0138667 A1 * 6/2011 Bolden ..... F41C 27/00 42/1.01
2011/0252682 A1 * 10/2011 Delgado Acarreta ..... F41A 9/62 42/1.02
2012/0152649 A1 * 6/2012 Larue ..... F41A 21/30 181/223
2012/0291614 A1 * 11/2012 Koumbis ..... F41A 21/30 89/14.4
2013/0042514 A1 * 2/2013 Douglas ..... F41A 9/65 42/50
2014/0262605 A1 * 9/2014 Washburn, III ..... F41A 21/30 181/223
2014/0311003 A1 * 10/2014 Loreman ..... F41A 9/62 42/1.02
2014/0317980 A1 * 10/2014 Michel ..... F41A 3/66 42/6
2014/0366419 A1 * 12/2014 Allan ..... F41A 17/06 42/70.06
2015/0159847 A1 * 6/2015 Galli ..... F21V 23/0414 362/111
2015/0354422 A1 * 12/2015 Liskey ..... F41A 21/30 89/14.4
2015/0377572 A1 * 12/2015 Darragjati ..... F41A 9/65 42/50
2015/0377574 A1 * 12/2015 Cooke ..... F41A 17/063 42/70.11
2016/0003570 A1 * 1/2016 Tonkin ..... F41A 21/02 89/14.4
2016/0076838 A1 * 3/2016 Hurst ..... F41A 17/00 42/1.05
2016/0169602 A1 * 6/2016 Demierre ..... F41A 9/70 42/1.02
2017/0038178 A1 * 2/2017 Pinilla ..... F41G 11/003
2017/0284759 A1 * 10/2017 Lau ..... F41A 21/30

FOREIGN PATENT DOCUMENTS

FR 2 717 890 A1 9/1995
WO WO 01/61269 A1 8/2001
WO WO 2015/083110 A1 6/2015

* cited by examiner

FIREARM NOISE SUPPRESSOR

CROSS-REFERENCE TO RELATED APPLICATIONS

This application claims priority to Provisional Application U.S. Ser. No. 62/187,308 filed on Jul. 1, 2015, which is herein incorporated by reference in its entirety.

BACKGROUND OF THE INVENTION

The present invention is directed to a firearm silencer and more particularly to a silencer which utilizes internal reflection of shock waves and redirection of propulsive gasses to attenuate noise.

Silencers for firearms are well-known in the art and are designed to lower sound levels caused by firing a firearm. While effective in lowering sound, existing silencers often affect the performance of the firearm by decreasing velocity or affecting the flight path of the projectile. Present silencers also do not adequately address propellant gases. Therefore, a need exits in the art for a device that addresses these needs.

An objective of the present invention is to provide a silencer that utilizes a truss structure to redirect shock waves and lower sound.

Another objective of the present invention is to provide a silencer that forces propellant gases into redirecting channels.

These and other objectives will be apparent to one of the ordinary skill in the art based upon the following written description.

SUMMARY OF THE INVENTION

Figure 1:
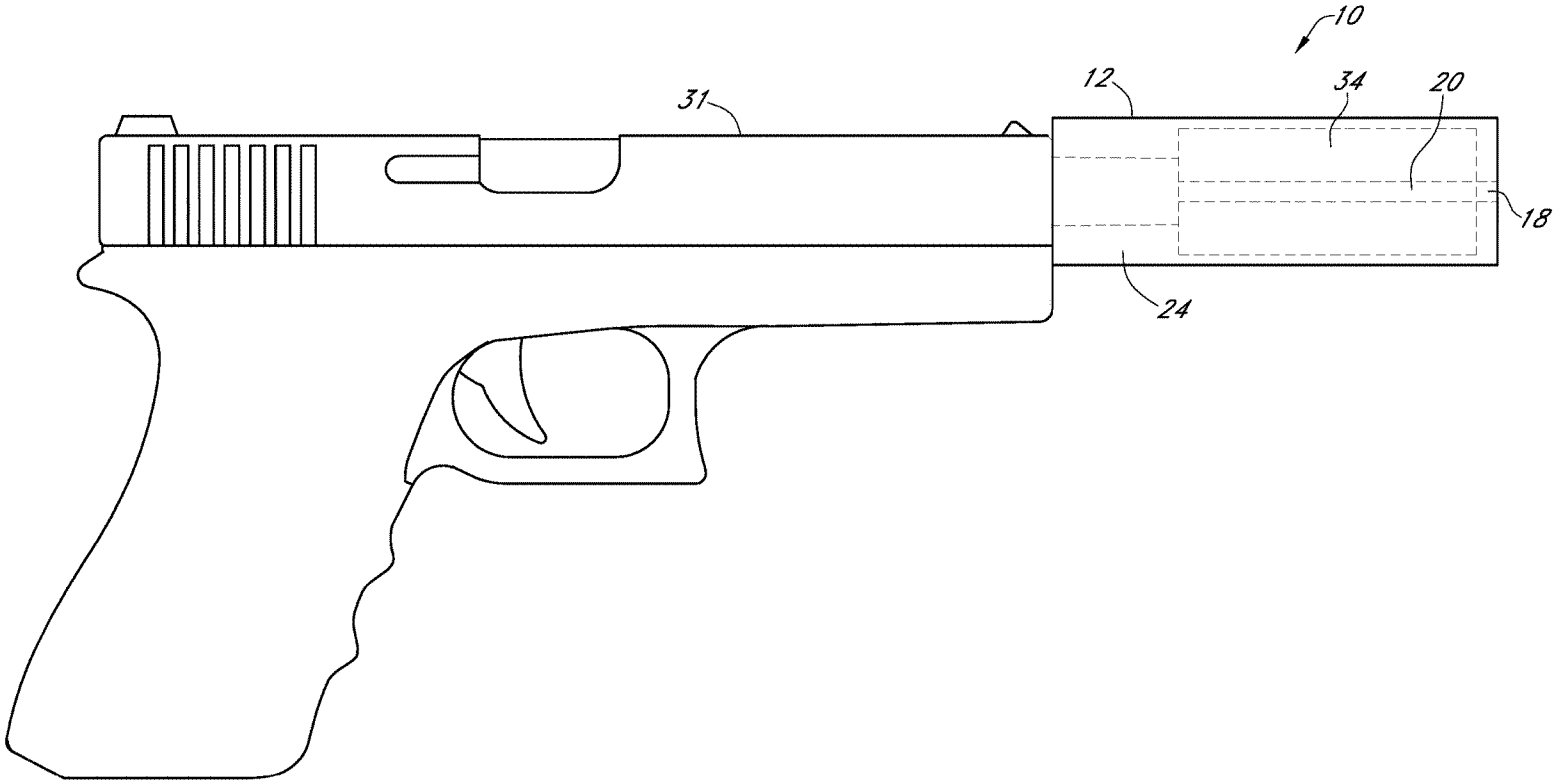
FIG. 1 is a side view of a firearm noise suppressor.

In general, the invention relates to a a firearm noise suppressor 10 which utilizes internal reflection of shock waves and redirection of propulsive gases released to reduce sound when firing a firearm. The firearm noise suppressor has an elongated hollow body that has an endwall and central opening. Positioned partially within the hollow body is an inner tube that has open ends and is in communication with the central opening. Between the inner tube and an inner surface of the hollow body is a sound attenuation truss structure that disrupts shock waves by breaking them into multiple, reflected, discontinuous paths and redirects propellant gasses into multiple, constantly redirecting channels which results in energy absorption and reduced firearm noise. The end wall of the hollow body terminates in a hub with a centrally located bore that receives the end of a barrel of a firearm and is thus connected to the firearm.

DETAILED DESCRIPTION OF THE PREFERRED EMBODIMENTS

Referring to the Figures a firearm noise suppressor 10 includes an elongated hollow body 12 that may be cylindrical, or other shape which provides enough internal volume to effectively quiet the firing, yet not restrict the firearm sighting-plane. The body 12 has a first end 14 having an end wall 16 and a central opening 18. Extending partially within the body 12, from end wall 16 of the first end 14, is an inner tube 20. Inner tube 20 is in communication with central opening 18 and has open ends.

The body 12 has a second end 22 having an end wall 24 that terminates into an outwardly extending hub 26. The hub 26 has a centrally located bore 28 that preferably has a threaded portion 30 and is formed to receive the end of a barrel of a firearm 31.

Figure 2:
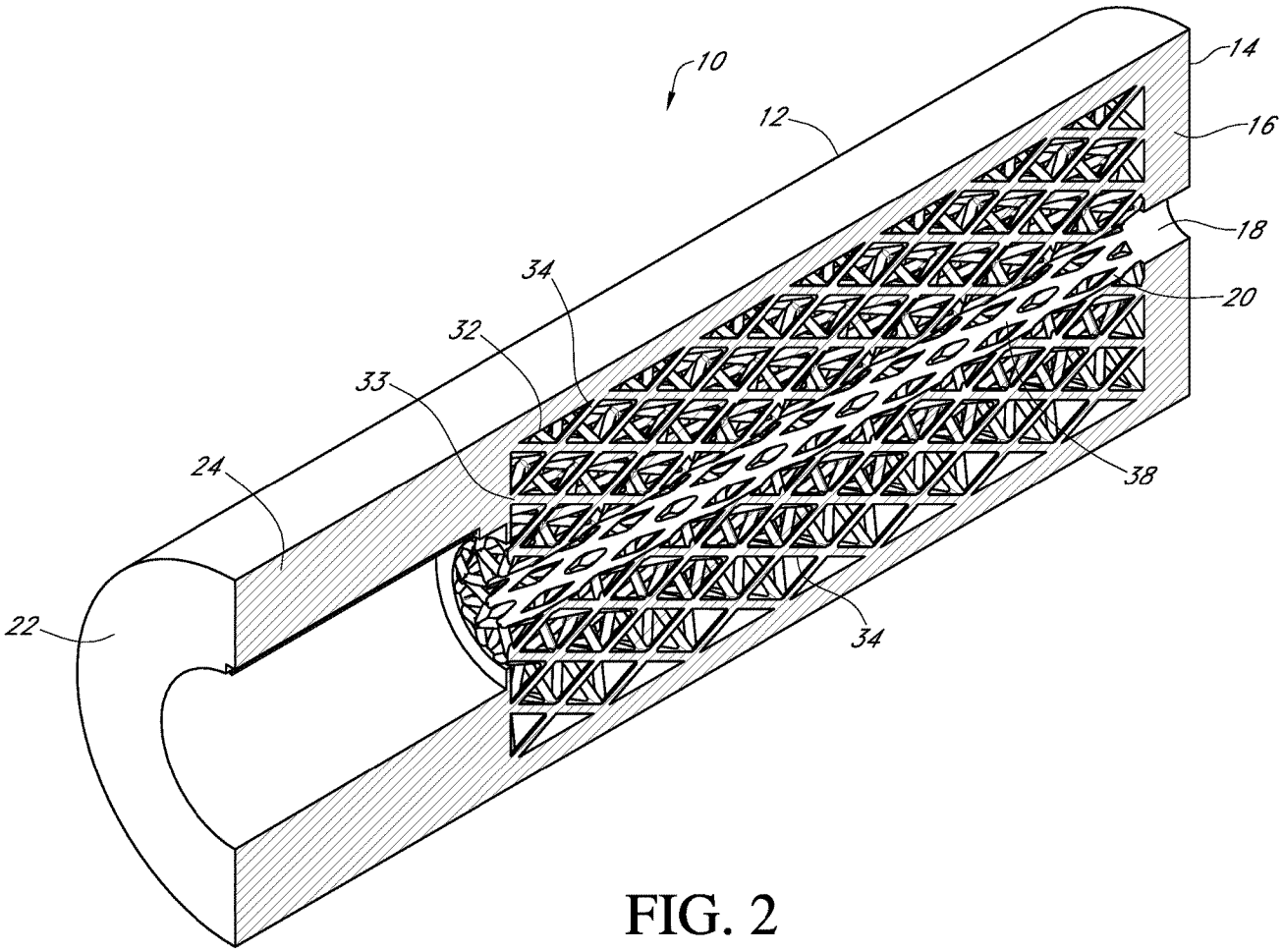
FIG. 2 is a perspective cross-sectional view of a firearm noise suppressor.
Figure 3:
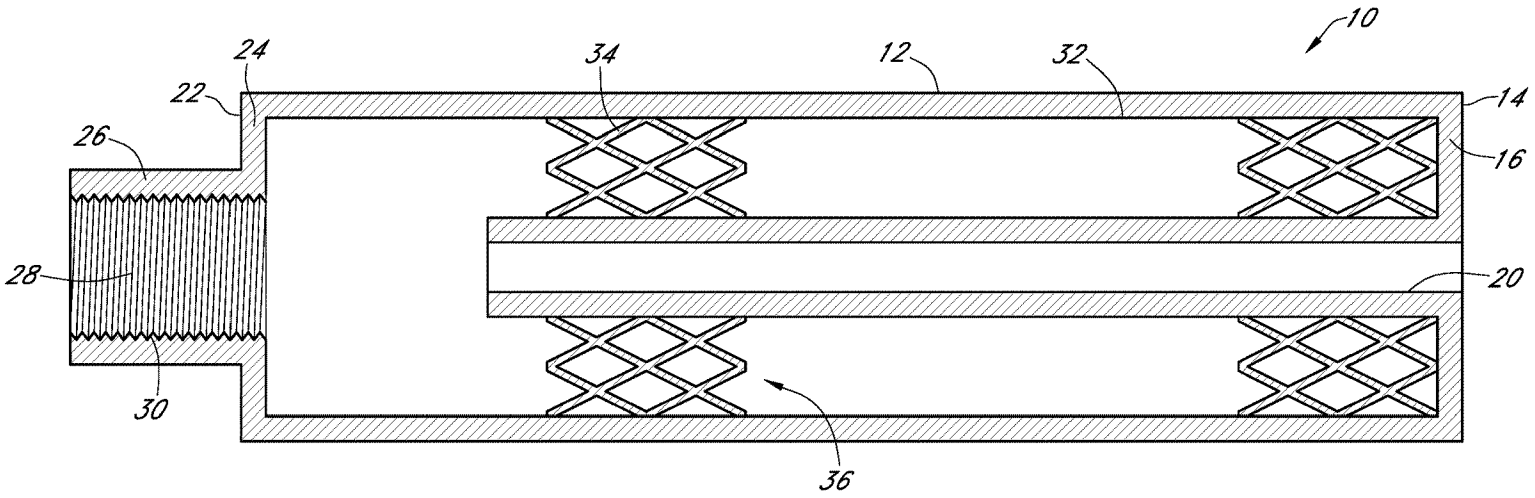
FIG. 3 is a perspective cross-sectional view of a firearm noise suppressor.
Figure 4:
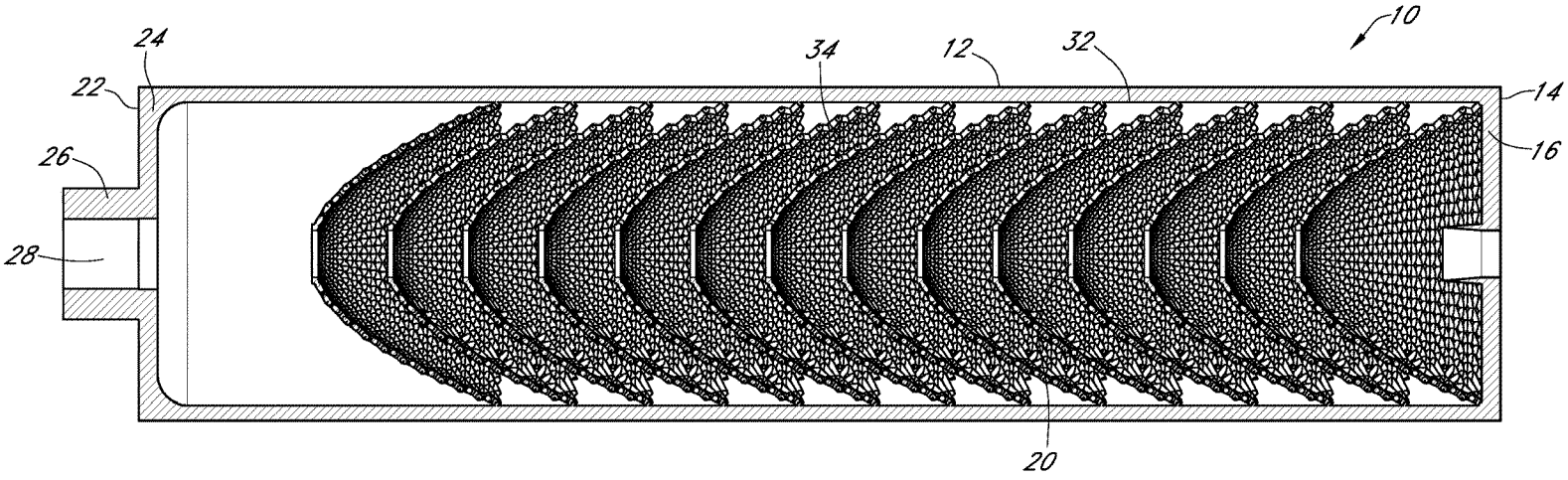
FIG. 4 is a perspective cross-sectional view of a firearm noise suppressor.

Positioned between the inner tube 20 and an inner surface 32 of the body 12 is a sound attenuation truss structure 34. The truss structure 34 in one arrangement, like the exemplary embodiment depicted in FIG. 2, is configured to have a web pattern that includes a labyrinth, scaffolding, filaments, beams, branches, stringers, sold walls and/or the like. In another embodiment, the truss structure 34 is configured in a parabolic pattern, for example the embodiment displayed in FIG. 3. In another embodiment the truss structure 34 is configured in a bone-like structure, i.e. randomized, porous, or holey pattern, as the example shown in FIG. 5. Formed to break shock waves into multiple, reflected, discontinuous paths, the truss structure 34 also forces propellant gases into multiple, constantly redirecting channels, yielding energy absorption, and sound attenuation.

Figure 5:
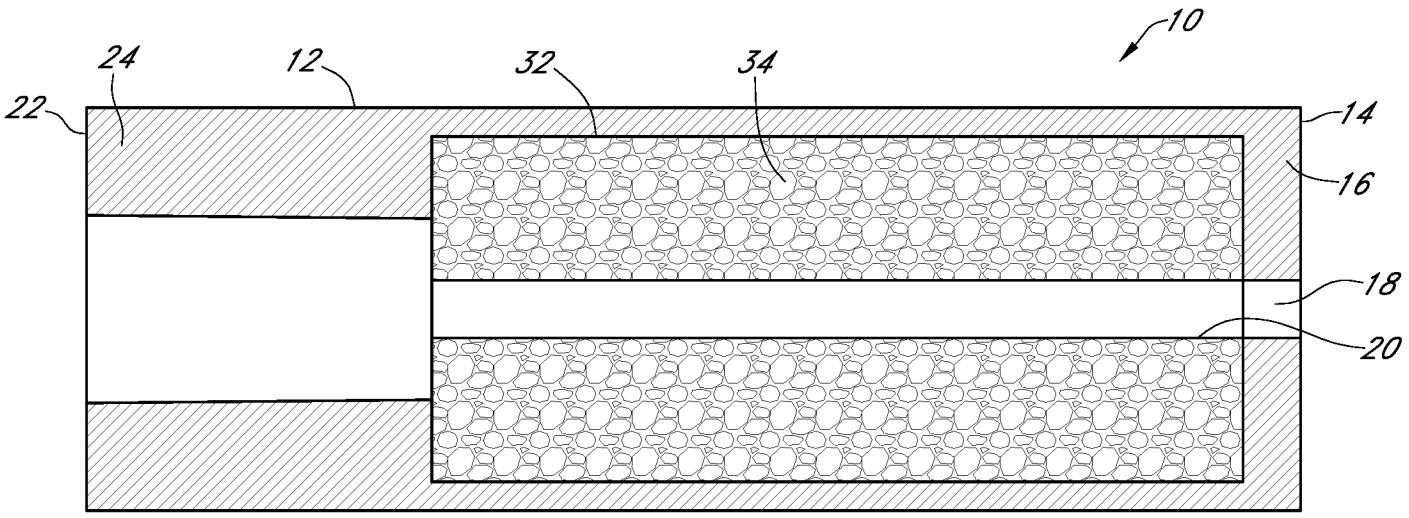
FIG. 5 is a perspective cross-sectional view of a firearm noise suppressor.

In one embodiment, as shown in FIGS. 1, 2, and 5, the diameter of the inner surface 32 of the body 12 is smaller at the second end 22 in relation to the diameter of the inner surface 32 at the first end 14. As a result a shoulder 33 is formed within the hollow body 12 that holds the truss 34 in place while still providing fluid/gas communication to the end of the truss 34 from the second end 22 of the body 12.

In an alternative embodiment, the inner tube 20 and truss structure 34 are broken into multiple segments 36 separated from one another. Also, the inner tube 20 may be made having a semi-hollow casing 38 such as a honeycomb metal panel. The noise suppressor 10 preferably is one-piece, made from 3-D metal printing.

What is claimed:

1. A firearm noise suppressor comprising:

an elongated hollow body having a first end, a second end, and a centrally located opening;

the second end having an end wall that terminates directly into an outwardly extending hub having a centrally located bore;

an inner tube extending only partially within the body from the first end;

a sound attenuation truss structure positioned between the inner tube and an inner surface of the hollow body;

wherein the sound attentuation truss structure has a configuration selected from the group consisting of a web pattern and a bone-like structure; and wherein the inner tube is at least partially formed by the sound attenuation truss structure; and wherein the noise suppressor is of one-piece, monolithic construction.

2. The firearm noise suppressor of claim 1 further comprising the bore having a threaded portion.

3. The firearm noise suppressor of claim 1 wherein the sound attenuation truss structure is configured to quiet the firing of a firearm.

4. The firearm noise suppressor of claim 1 wherein the hollow body is positioned to allow full firearm sighting-plane view.

5. The firearm noise supporessor of claim 1 further comprising the inner tube having a semi-hollow casing.

6. The firearm noise suppressor of claim 1 further comprising the truss structure having multiple, separate segments.

7. The firearm noise suppressor of claim 1 wherein the inner surface of the hollow body has a first diameter smaller than a second diameter that form a shoulder adapted to hold the sound attenuation truss structure in place.

8. The firearm noise suppressor of claim 1 wherein the sound attentuation truss structure is configured to break a shock wave into multiple, reflected, and discontinuous paths.

9. The firearm noise suppressor of claim 8 wherein the sound attentuation truss structure is configured to break a shock wave into multiple, reflected, and discontinuous paths.

10. A firearm noise suppresor, comprising:

an elongated hollow body having a first end and a second end;

an inner tube extending only partially within the elongated hollow body from the first end;

a sound attenuation truss from the inner tube to an inner surface of the hollow body, and from the first end along the length of the inner tube;

wherein the sound attentuation truss structure has a configuration selected from the group consisting of a web pattern and a bone-like structure; and wherein the inner tube is formed by the sound attenuation truss structure; and wherein the noise suppressor is of one-piece, monolithic construction.

11. A firearm noise suppressor comprising:

an elongated hollow body having a first end, a second end, and a centrally located opening;

the second end having an end wall that terminates directly into an outwardly extending hub having a centrally located bore;

an inner tube extending within the body from the first end;

a sound attenuation truss structure extending from the inner tube and to an inner surface of the hollow body;

wherein the sound attentuation truss structure is configured to break a shock wave into multiple, reflected, and discontinuous paths; and wherein the inner tube is at least partially formed by the sound attenuation truss structure; and wherein the noise suppressor is of one-piece, monolithic construction.

* * * * *